US006385408B1

(12) United States Patent
Scheuer

(10) Patent No.: US 6,385,408 B1
(45) Date of Patent: May 7, 2002

(54) DETECTING THE LOCATION OF A SENSORS FIELD OF VIEW

(75) Inventor: Mark A. Scheuer, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/682,384

(22) Filed: Aug. 27, 2001

(51) Int. Cl.[7] ..... G03G 15/00
(52) U.S. Cl. ..... 399/49; 399/15; 430/120
(58) Field of Search ..... 399/49, 72, 15, 399/46; 324/71.1, 452; 358/296, 406, 504; 430/120

(56) References Cited

U.S. PATENT DOCUMENTS 5,576,811 A * 11/1996 Kobayashi et al. ..... 399/15 X
5,652,946 A * 7/1997 Scheuer et al. ..... 399/49
6,044,234 A * 3/2000 Yoshizawa ..... 399/49
6,122,075 A * 9/2000 Yamada et al. ..... 399/72 X

FOREIGN PATENT DOCUMENTS

JP 11-143147 * 5/1999

* cited by examiner

*Primary Examiner*—Sophia S. Chen
(74) *Attorney, Agent, or Firm*—Oliff & Berridge, PLC

(57) ABSTRACT

A method for determining a sensor field of view with respect to a test patch and aligning the test patch with the sensor field of view. The apparatus and method according to this invention additionally allows for utilizing the results of the determined field of view to aid in controlling the various system parameters of the image printing system.

24 Claims, 6 Drawing Sheets

DETECTING THE LOCATION OF A SENSORS FIELD OF VIEW

BACKGROUND OF THE INVENTION

1. Field of Invention

This invention is generally related to systems and methods for determining the field of view of a sensor.

2. Description of Related Art

It is known in the art to provide developability sensors for analyzing toner-developed test patch areas. These test patch areas are generated on the surface of a photoreceptor of a xerographic image forming apparatus to obtain a measure of the image quality of that image forming apparatus.

The xerographic imaging process is initiated by charging a charge retentive surface, such as that of a photoconductive member, to a uniform potential. The charge retentive surface is then exposed to a light image of an original document, either directly or via a digital image driven laser. Exposing the charged photoconductor to light selectively discharges areas of the surface while allowing other areas to remain unchanged. This creates an electrostatic latent image of the document on the surface of the photoconductive member.

Developer material is then brought into contact with the surface of the photoconductor material to develop the latent image into a visible reproduction. The developer typically includes toner particles with an electrical polarity that is the same as, or that is opposite to, the polarity of the charges remaining on the photoconductive member. The polarity depends on the image profile.

A blank image receiving member is then brought into contact with the photoreceptor and the toner particles are transferred to the image receiving member. The toner particle forming the image on the image receiving member are subsequently heated, thereby permanently fixing the reproduced image to the image receiving member.

Electrophotographic or xerographic laser printers, scanners, facsimile machines and similar document reproduction devices must be able to maintain proper control over the systems of the image forming apparatus to assure high quality output images. For example, the level of electrostatic charge on the photographic member must be maintained at a certain level to be able to attract the charged toner particles. The light beam must have the proper intensity in order to be able to discharge the photoreceptor. In addition, the toner particles must be at the proper concentration to ensure high print quality. As the image forming apparatus continues to operate, changes in operating conditions will cause these parameters to vary from their initial values. For example, an increase in the humidity in the environmental conditions around the corona discharge device used to generate the electrostatic charge on the photoreceptor will cause a decrease in the magnitude of the charge that is ultimately placed on the photoreceptor.

Changes due to the variation in various operative components of the image forming apparatus impact print quality. Thus, it is desirable to monitor the operating parameters of the image forming apparatus to ensure proper operation of the image forming apparatus.

One way to control the many parameters that operate together as the image forming apparatus reproduces images is to use one or more process control patches strategically positioned on the photoconductive or charge-retaining member of the image forming apparatus. The one or more control patches are usually generated by sending a known pattern of data to control the modulation of the light emitting elements in an exposure station. Since the data patterns are known, the various system parameters, such as the electrostatic charge that must be present on the surface of the photoreceptor to create the developed resultant image, can be determined. The one or more control patches are deposited onto a small area of the photoreceptor between areas reserved for placement of the latent images. This area is called the interpage zone.

In existing xerographic print engines, sensor readings of toner control patches serve many purposes. One purpose is to provide a basis for adjusting the appropriate system parameters, such as corona charging and developer dispense rates to maintain print image quality. Another purpose is to provide a basis for identifying and declaring system fault conditions, such as a photoreceptor voltage which is too high or too low, i.e. a determination of whether a voltage reading is outside of a target voltage range.

SUMMARY OF THE INVENTION

Prior art techniques for accomplishing control of system parameters require a large number of toner patch readings resulting in a significant waste of toner. Thus, for system control, there is a strong desire to reduce the number of readings to the minimum required to adequately maintain the system parameters in order to conserve toner.

However, reducing the number and or size of test patches that must be produced is in some sense dependent on knowing the relative location of the field of view of a sensor, such as a densitometer, on the photoreceptor surface. Conventionally, the field of view of the sensor on the photoreceptor cannot be observed. As a result, conventionally, it was not possible to limit the size of the test patches to only that sufficient to fill the field of view of a sensor.

The invention provides systems and methods that locate a field of view of a sensor based on observations of disturbances created in the element being viewed with the sensor due to interactions between the sensor and the element.

This invention separately provides systems and methods that determine the location of a field of view of a sensor relative to a surface of a photoreceptor.

This invention further provides systems and methods that locate the field of view of a light-emitting sensor relative to the surface of the photoreceptor by observing the disturbances created in a test patch formed on the surface of the photoreceptor due to the light emitted by the sensor.

In various exemplary embodiments the systems and methods of this invention, a test patch is formed on a photoreceptor and passed past a light-emitting sensor. In normal operation, the light emitting sensor generally creates little disturbance in the test patch. The area of the test patch viewed by the sensor, which generally cannot extend beyond the area of the test patch illuminated by the sensor. According to the systems and methods of this invention, the light source of the sensor is driven sufficiently to create a measurable or observable disturbance in the test patch. In these embodiments, the is disturbance is a discharging of the charge on the photoreceptor used to create the test patch.

As a result, some toner previously attached to the discharged image area of a test patch region of the photoreceptor, that lies within the area illuminated by the sensor's light source, is now electrostatically attracted to the discharged background area of the photoreceptor. The illuminated portion of the test patch thus contains a different distribution of toner than the non-illuminated portion. The location of this disturbed portion can be sensed or observed, either automatically or by a user. The extent and location of the test patch can thus be reduced to generally correspond to just the location of the disturbed portion of the test patch, and to generally about the same extent since the field of view of the sensor should lie within the illuminated area, and the illuminated area generally corresponds to the observed disturbed area, the location of the field of view of the sensor is determined.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of this invention will be described in detail with respect to the following drawings, in which like reference numerals indicate like elements, and wherein.

DETAILED DESCRIPTION OF PREFERRED EMBODIMENTS

Various exemplary embodiments of the systems and methods according to this invention are directed to obtaining information about the location of a field of view of a sensor used to sense a test patch formed on a photoreceptor. A user obtains this information by observing a disruption caused on the test patch by the sensor as the sensor views the test patch.

For ease of understanding and clarity, the following description of the system and methods of this invention are directed to a specific type of sensor, an optical densitometer, that illuminates the test patch to sense information about the test patch. However, it should appreciated that the systems and methods of this invention can use any type of sensor that creates a measurable or observable disruption in the test patch such that the field of view of the sensor on the photoreceptor can be determined.

More generally, the systems and methods of this invention can be used with any sensor and any sensible element where the sensor, or an element of the sensor, can be used to create a detectable or observable disturbance in the sensible element being sensed by the sensor. Thus, the systems and methods of this invention are not limited to the sensors and sensible elements used in the following exemplary embodiments.

As indicated above, while the systems and methods of this invention can be applied to any suitable type of sensor, the following description will focus on an optical densitometer. In general, the optical densitometer is one type of developability sensor. In particular, the optical densitometer can be a reflective densitometer or toner mass sensor that measures developed mass per unit area, or "DMA" of a developed image on a photoreceptor. This reflective densitometer is referred to herein as an enhanced toner area covered sensor or "ETACS". That is, an ETACS is one type of DMA sensor and more generally, is one type of developability sensor. An ETAC sensor is an optical, noncontact sensor. The ETAC sensor can also be used in a transmissive mode.

Figure 1:
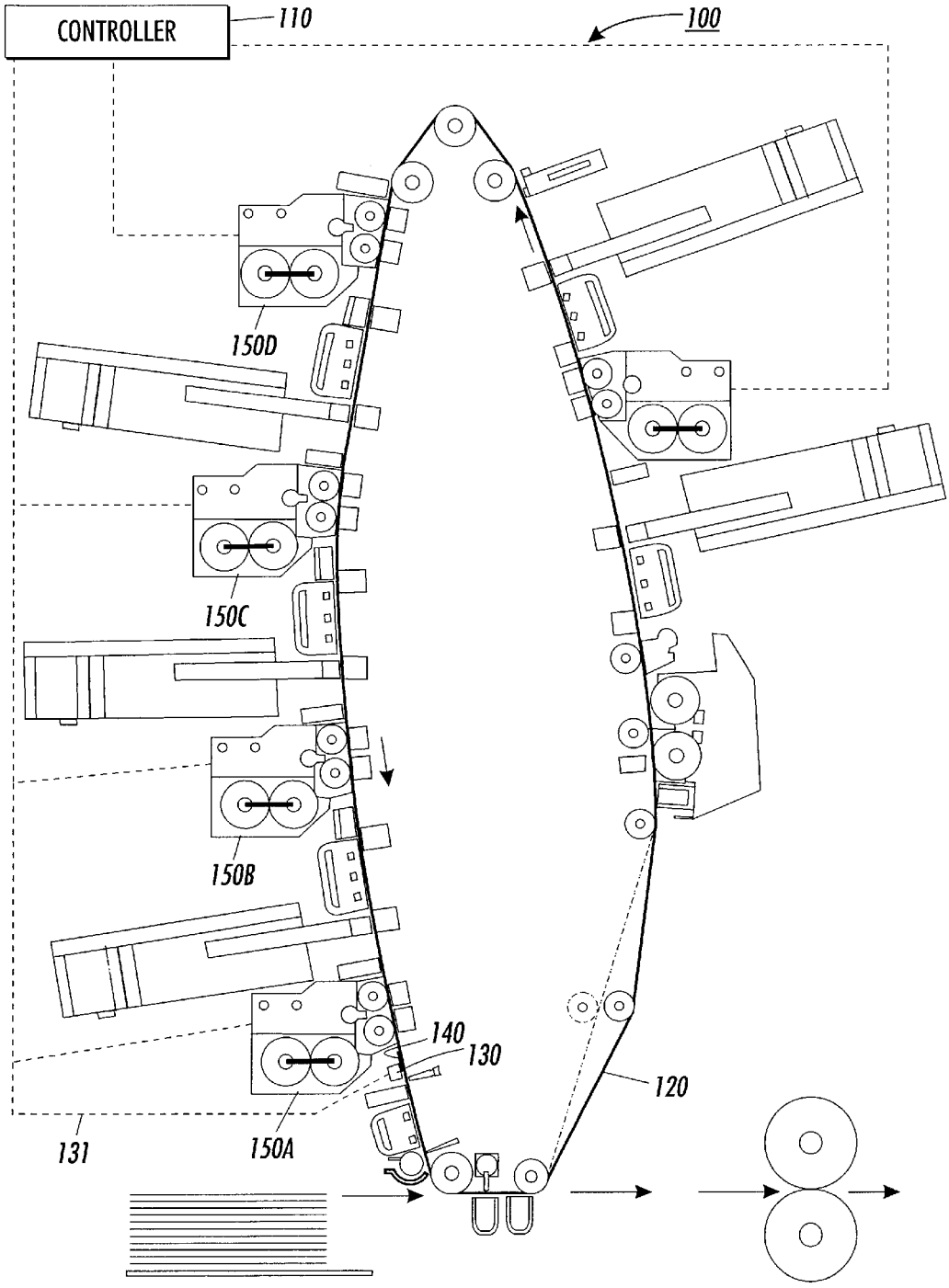
FIG. 1 shows a first exemplary embodiment of a xerographic image forming apparatus in which one exemplary embodiment sensor may be mounted to sense test patches developed on a photoreceptor.

FIG. 1 shows a first exemplary embodiment of an image forming apparatus 100 with a photoreceptor 120. The image forming apparatus 100 can be a xerographic printer or other known or later developed xerographic device. It should be appreciated that the specific structures of the image forming apparatus are not relevant to this invention and thus are not intended to limit the scope of this invention.

As shown in FIG. 1, one or more toner test patches 140 can be generated and developed on the photoreceptor 120 in a well known manner, by controlling one or more of a number of different developer units 150A, 150B, 150C, and 150D using a controller 110.

The sensing system of the image forming apparatus can include one or more exemplary ETAC sensors 130 positioned adjacent to the photoreceptor 120. The ETAC sensor 130 optically senses the toner density in the test patches 140 as the test patches 140 pass by one of the one or more ETAC sensors 130. It should be understood that the one or more ETAC sensors 130 can be positioned at various locations adjacent to the photoreceptor 120.

The output signals from the one or more ETAC sensors 130 may be used to maintain and control one or more image forming parameters, such as developability, based on the sensor signals provided by the one or more ETAC sensors 130 over one or more signal lines 131 to the controller 110.

Figure 2:
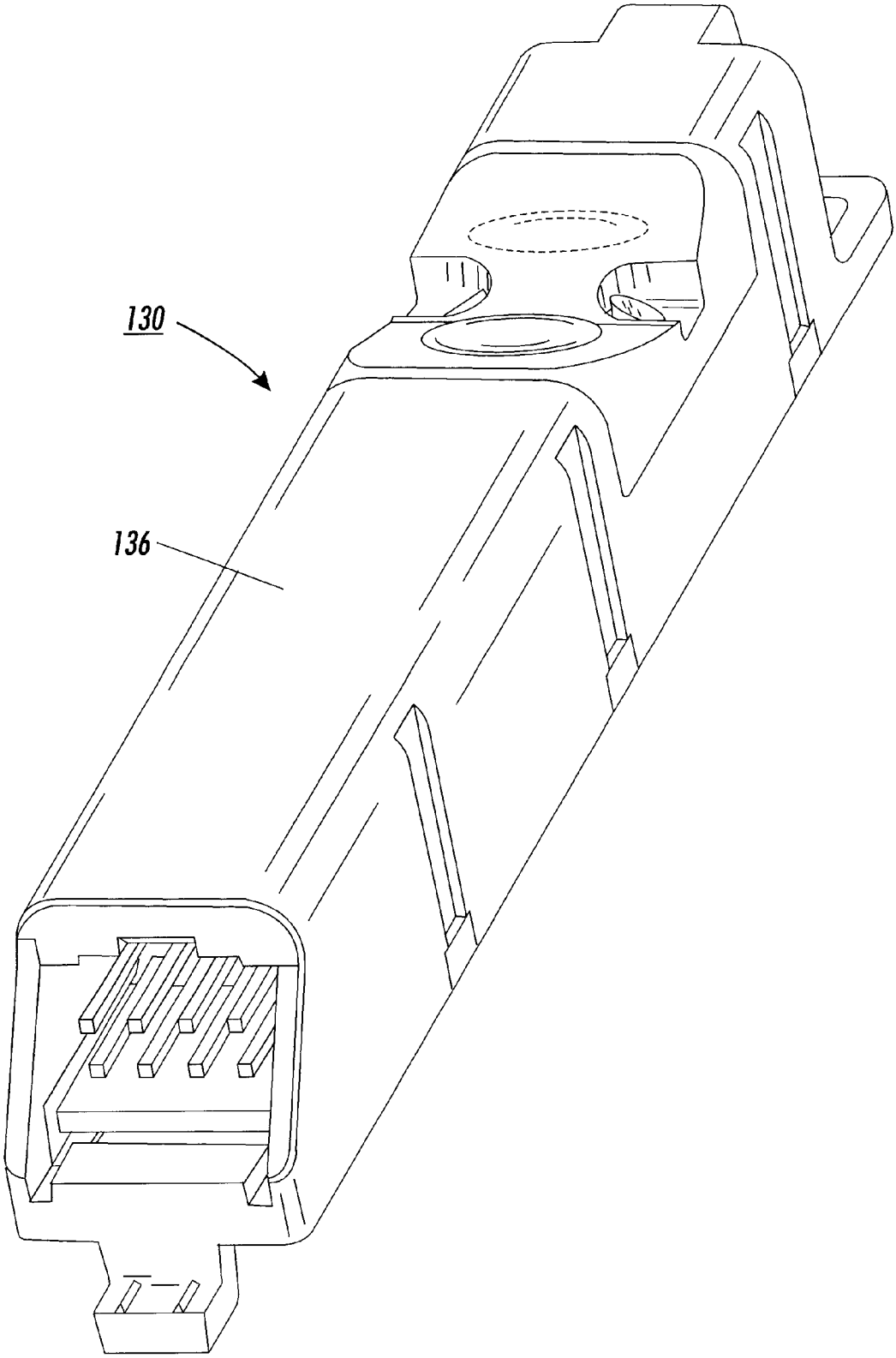
FIG. 2 shows a perspective view of one exemplary embodiment of the sensor of FIG. 1.

FIG. 2 shows a typical ETAC sensor. The ETAC sensor 130 is a small integral unit having a housing 136 and a small laser diode or any other known or later developed light source that is located in the housing 136. The housing 136 of the ETAC sensor 130 may be a single plastic molding. The housing 136 includes lens and lenslets integrally molded into the housing 136. The light source is used to illuminates a small area of the imaged surface of the photoreceptor 120. In various exemplary embodiments, the light sources emit infra-red frequency light. The imaged surface examined by the ETAC sensor 130 can include a photoreceptor, an intermediate transfer surface or a final substrate surface. In various exemplary embodiments, the plastic material forming the housing 136 is visibly pigmented black with an organic dye. The dye helps to block visible light but to also transmit the infra-red light from the light sources through the lenses and lenslets.

Figure 3:
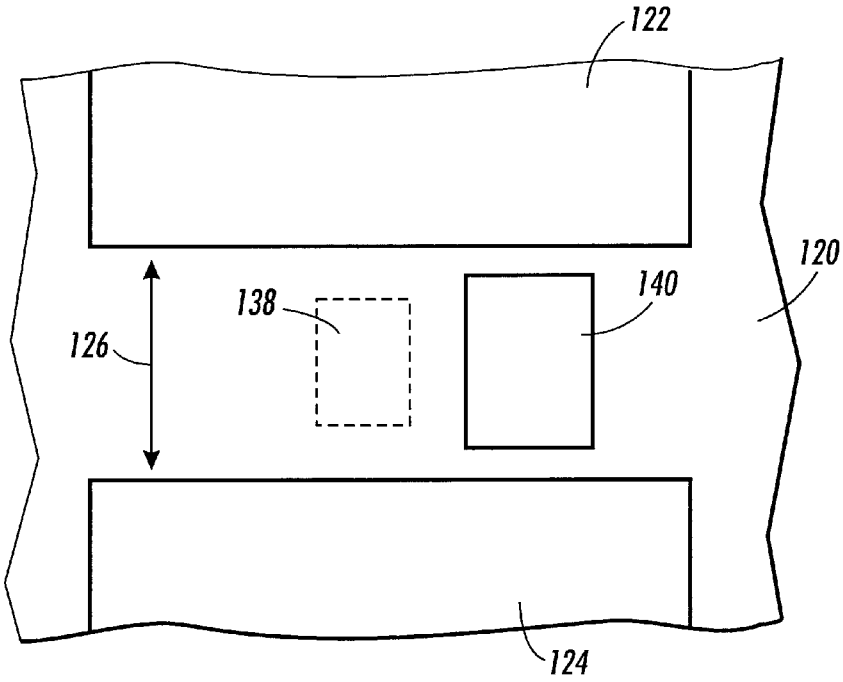
FIG. 3 shows a view of a photoreceptor illustrating a Interpage zone containing a test patch and indicating a field of view of the sensor.

As shown in FIG. 3, the photoreceptor 120 contains at least one interpage zone 126. The interpage zone 126 is located in the space between successive images areas 122 and 124 of the photoreceptor 120.

As is well known in the art, one or more patches 140 can be located in the interpage zone 126. It should be appreciated that, according to the exemplary embodiments of this invention, the size of the patches 140 can vary.

Additionally, a field of view 138 of the ETAC sensor 130 is positioned so that, when the interpage zone 126 passes by the field of view 138, the field of view 138 intersects one of the test patches 140. As discussed above, the ETAC sensor 130 detects the information contained in the test patch 140 and relays the information to the controller 110 over the signal line 131. In FIG. 3, the field of view 138 of the ETAC sensor 130 is not shown to scale but rather is shown in a size in relation to the corresponding patch 140.

As outlined above, the information obtained by the one or more ETAC sensors 130 from the test patches 140 is used by the controller 110 to adjust or otherwise control one or more of the various systems an/or operating parameters of the image forming apparatus 100. This necessarily requires that each test patch 140 pass through the field of view 138 of the appropriate one of the ETAC sensors 130 as the interpage zone 126 passes by the one or more ETAC sensors 130. However, as outlined above, it is not possible to directly observe the position of the field of view 138 on the photoreceptor 120.

This problem was conventionally avoided by placing toned test patches 140 in the interpage zone 126 so that the test patches 140 extended a significant distance, if not fully, across the width of the photoreceptor 120. However, as noted above, this wastes toner, and either adds an additional burden to the residual toner cleaning system or wastes a sheet of recording media when the toned test patches 140 are transferred to the recording media. Importantly, prior to this invention, such recording media carrying the test patches 140 were discarded as wasted or useless.

In contrast, in the systems and methods according to this invention, the test patches 140 are intentionally transferred to a sheet of recording media. The test patches on the sheet of recording media are then analyzed, either manually or automatically, to determine the locations of disturbed areas 141 within the test patches 140. The disturbed areas 141 are indicative of the position of the field of view 138 of the ETAC sensor 130 relative to the interpage zone 126 and/or the test patches 140. Once these relative positions are determined, since the location of the field of view 138 in now known, the size and location of the test patch 140 can be reduced to approximately the size and location of the field of view 138.

As a result, in a discharge development system, some toner previously attached to the discharged image areas of a test patch region of the photoreceptor, that lies within the area illuminated by the sensor's light source, is now electrostatically attracted to the previously charged, but now discharged, background areas of the photoreceptor.

In a discharge development system, toner develops where the charge is exposed away and does not develop where the charge remains. So, for a halftone image, toner develops in the exposed dots but keeps clear of the charged background areas around the dots. The sensor, however, exposes a stripe through the image in both the image and background areas. The image areas, being already exposed, are unaffected. The background areas, however, get exposed, lose their charge, and then equally attract toner as the image areas do. The only supply of toner is that in the dots so some toner jumps from the dots into the background area, smearing out the image. This smear, as stated, is the width of the illuminated area.

In contrast, in a charge development system, the sensor's light source discharges at least some of the charged image areas that lie within the area illuminated by the sensor's light source. As a result, some toner previously attached to the charged image areas of the test patch region of the photoreceptor, that lie within the area illuminated by the sensor's light source is no longer electrostatically attracted to the now-discharged image areas on the photoreceptor and falls away.

The illuminated portion of the test patch thus contains a different distribution of toner than the non-illuminated portion. The location of this disturbed portion can be sensed or observed, either automatically or by a user. The extent and location of the test patch can thus be reduced to generally correspond to just the location of the disturbed portion of the test patch, and to generally about the same extent since the field of view of the sensor should lie within the illuminated area, and the illuminated area generally corresponds to the observed disturbed area, the location of the field of view of the sensor is determined.

Once the field of view 138 of the ETAC sensor 130 and the test patch 140 are aligned, a final test patch can be generated and output on a sheet of recording media to confirm the alignment. Accordingly, this sheet of recording media will confirm to the user that the test patch 140 is located in the appropriate position for sensing by the ETAC sensor 130. In this situation and during operation of the image forming apparatus 100, the ETAC sensor 130 can accurately detect the information contained in the test patch 140.

Figure 5:
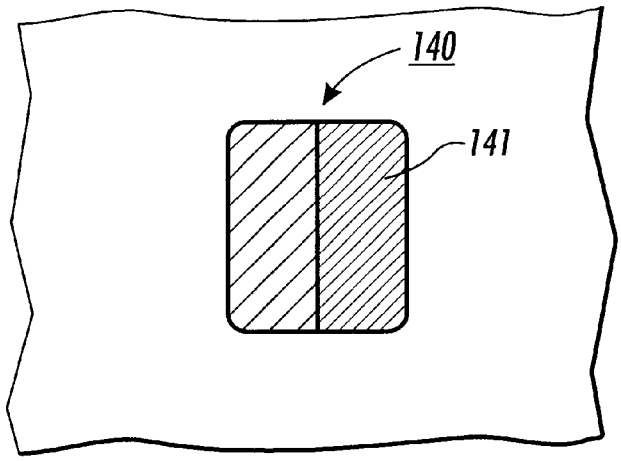
FIG. 5 shows a developed test patch resulting from the relative positions of the test patch and the sensor's field of view as shown in FIG. 4.
Figure 7:
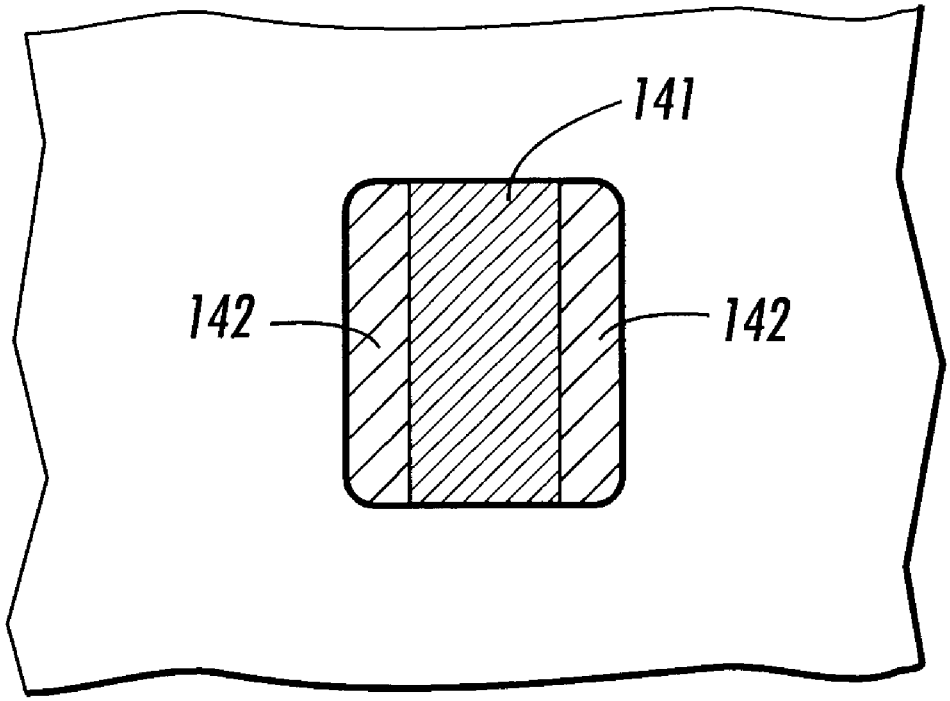
FIG. 7 shows a developed test patch resulting from the relative positions of the test patch and the sensor's field of view as shown in FIG. 6.

In operation, when attempting to determine the location of the field of view 138, the intensity of the infra-red internal light source of the ETAC sensor 130 is increased over the normal intensity used during sensing of the test patches 140. By exposing the developed test patches 140 on the photoreceptor 120 to this higher intensity light, the areas of the test patch 140 illuminated by the light, are more completely disturbed. As a result, as shown in FIGS. 5 and 7, toner in the disturbed area 141 of the developed test patch 140 becomes redistributed on the photoreceptor 120.

As a result of increasing the intensity of the infra-red light source, an area discharged or band will appear in the test patch 140 that corresponds to the location of the infra-red light source on the test patch 140 and thus corresponding the field of view 138 of the ETAC sensor 130. When this disturbed test patch 140 having a disturbed area 141 is output on a sheet of recording media, the location of the disturbed area 141 can be observed, either automatically or by the user. It should be noted that since the photoreceptor 120 is in motion, the discharged or disturbed portion 141 of the test patch 140 will run from the top to the bottom of the test patch 140.

As such, when the test patch 140 moves past the ETAC sensor 130 and the corresponding sensor field of view 138, the band or area disturbed 141 will appear in the test patch 140.

According to an exemplary embodiment of the invention, the band or disturbed area 141 will completely appear in the test patch 140. In this exemplary embodiment, the user will know the field of view 138 and test patch 140 are in alignment. Further, this will allow the image forming apparatus 100 to more accurately detect information from the test patch 140 make appropriate adjustments.

FIG. 3 shows a situation where the test patch 140 is located outside of the field of view 138 of the sensor 130. In this situation, the ETAC sensor 130 will not detect the test patch 140. Accordingly, during operation, the ETAC sensor 130 would not detect information contained in the test patch 140 and thus, no data will be supplied to the controller 110 about the system parameters of the image forming apparatus 100. As such, the user knows adjustments need to be made and the test patch 140 needs to be relocated.

Figure 4:
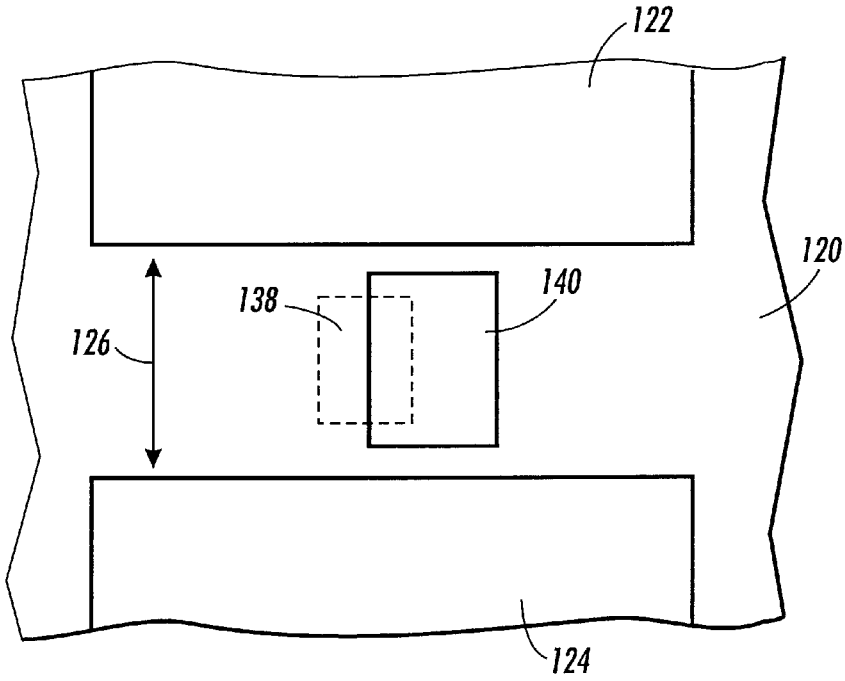
FIG. 4 shows the location of a test patch with respect to the sensor's field of view prior to adjusting the sensor's field of view.

FIG. 4 shows a situation when the test patch 140 is not entirely contained within the sensor field of view 138. Similar to FIG. 3, this is not the desired location of the test patch 140 and an adjustment of the test patch 140 location is required.

FIG. 5 shows the result of having the test patch 140 and field of view 138 in the positions shown in FIG. 4. The patch 140 will have an area disturbed 141 corresponding to the area covered by the sensor field of view 138. However, as shown in FIG. 5, the disturbed area 141 of the test patch 140 extends to an edge of the test patch 140. As a result, the user can not be sure that the entire field of view 138 is within the test patch 140. FIGS. 4 and 5 do not show the test patch 140 and field of view 138 substantially the same size. Thus, the user may still desire to adjust the size of the test patch 140 with respect to the determined size of the field of view 138.

Figure 6:
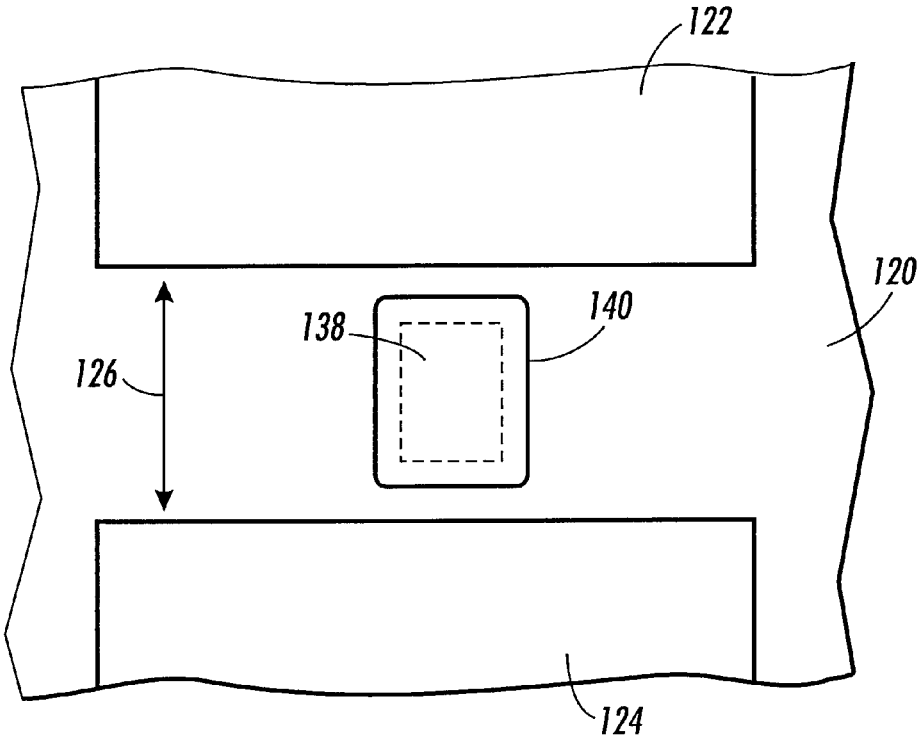
FIG. 6 shows the location of the sensor's field of view with respect to the test patch after adjusting the relative position of the test patch to the sensor's field of view according to one exemplary embodiment of the invention.

FIGS. 6 shows the situation according to an exemplary embodiment of the invention. In FIG. 6, the field of view 138 of the ETAC sensor 130 is located within the test patch 140. It should be appreciated that the field of view 138 does not have to be directly in the center of the patch 140, as long as the field of view is located within the boundaries of the patch 140. The situation of FIG. 6 thus illustrates one desirable position of the test patch 140.

FIG. 7 shows the results of relative positions between the field of view 138 and the test patch illustrated in FIG. 6. In this situation, viewing the test patch 140 allows the area disturbed 141, corresponding to the field of view 138, to be fully located. According to this exemplary embodiment, the area disturbed 141 is located between the undisturbed areas 142.

Accordingly, because the field of view of the ETAC sensor 130 is now known to be within the test patch 140, the size and location of the test patch 140 can be reduced. As a result, the amount of toner used in the test patches 140 can be reduced. Additionally, during operation of the image forming apparatus, the sensor 130 can accurately detect the information on the test patch 140.

Figure 8:
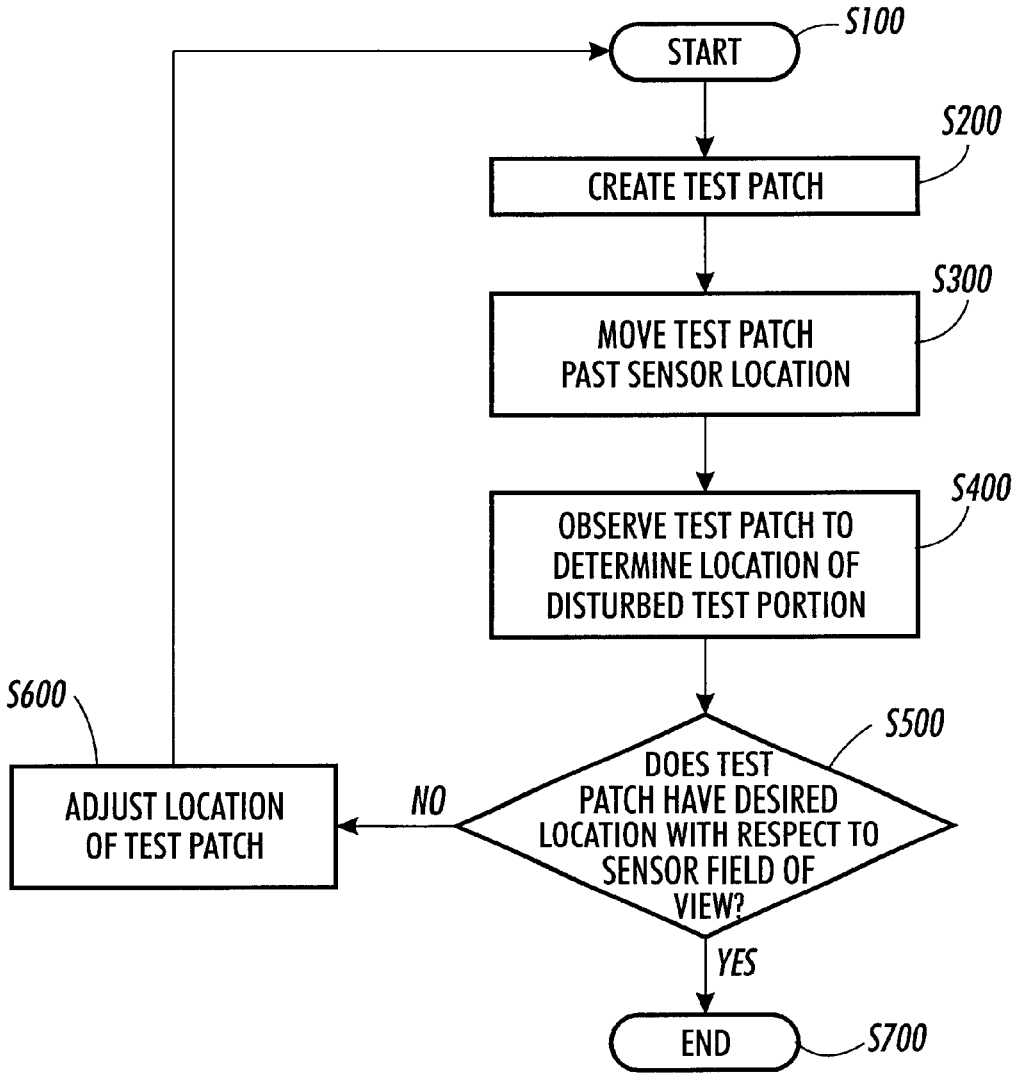
FIG. 8 is a flow chart outlining one exemplary embodiment of a method for adjusting the location of a test patch relative to a field of view of a sensor according to this invention.

FIG. 8 shows a flowchart outlining one exemplary embodiment of a method for adjusting the location of a test patch relative to a field of view of a sensor according to this invention.

Beginning in step S100 operation continues to step S200, where a test patch is created. Then in step S300, the test patch is moved past the sensor. While the sensor is driven in such a manner that it creates a disturbance in the test patch. Next, in step S400, the test patch is observed to determine the location of the disturbed test portion of the test patch. Operation continues to step S500.

In step S500, a determination is made whether the test patch is in the desired location with respect to the sensor's field of view. If the test patch is not in the desired location, control continues to step S600, where the location of the test patch is adjusted. Operation then returns to step S300. Otherwise, once the location the test patch relative to the field of view of the sensor reaches a desired state, operation continues to step S700, where the method ends.

While this invention has been described in conjunction with the exemplary embodiment outlined above, it is evident that many alternative, modifications and variations will be apparent to those skilled in the art. Accordingly, the exemplary embodiment of the invention, as set forth above, are intended to be illustrative, not limiting. Various changes may be made without departing from the spirit and scope of the invention.

What is claimed is:

1. A method of determining a location of a field of view of a sensor with respect to a sensible element, at least one characteristic of the sensible element disturbable by the sensor, comprising:

providing the sensible element;

moving the sensible element past the field of view of the sensor;

changing at least one of the at least one characteristic of the sensible element that is disturbable by the sensor, based on an interaction of the sensible element with the sensor;

obtaining data about the at least one of the at least one disturbed characteristic from the sensible element; and determining the location of the field of view of the sensor relative to the sensible element based on the obtained data.

2. The method of claim 1, wherein obtaining data comprises viewing the sensible element to determine the extent of change of the at least one of the at least one characteristic.

3. The method of claim 2, wherein obtaining data comprises determining the lateral extent of disturbance of the sensible element.

4. The method according to claim 1, wherein the sensible element is a test patch formed on a photoreceptor.

5. The method according to claim 4, wherein obtaining data comprises:

transferring the test patch to a recording medium;

outputting the recording medium; and viewing the output of the recording medium to discern the data.

6. The method of according to claim 4, wherein the sensor is an optical sensor.

7. The method according to claim 6, wherein changing at least one of the at least one characteristic of the test patch comprises disrupting a charge on an area of the photoreceptor underlying the test patch.

8. The method according to claim 7, wherein disrupting a charge on an area of the photoreceptor comprises operating a light source of the sensor at a greater than normal illumination.

9. The method according to claim 1, wherein the sensible element is a test patch carried on one of a photoreceptor, an intermediate transfer substrate or a final substrate surface.

10. A method of adjusting a location of a sensible element with respect to a field of view of a sensor, comprising:

providing the sensible element, the sensible element having at least one characteristic that is disturbable by the sensor;

moving the sensible element past the field of view of the sensor;

changing at least one of the at least one characteristics of the sensible element that is disturbable by the sensor based on an interaction of the sensible element with the sensor;

obtaining data about the at least one of the at least one disturbed characteristic from the sensible element; and adjusting the location of the sensible element relative to the field of view of the sensor based on the obtained data.

11. The method of claim 10, wherein adjusting the location of the sensible element comprises adjusting the position of the sensible element so that the field of view of the sensor does not extend laterally beyond the sensible element.

12. The method of claim 10, wherein obtaining data comprises viewing the sensible element to determine the extent of change of the at least one of the at least one characteristic.

13. The method of claim 12, wherein obtaining data comprises determining the lateral extent of disturbance of the sensible element.

14. The method of claim 12, wherein determining the extent of change comprises determining the change in image density due to a disruption of a charge of the sensible element.

15. The method of claim 14, wherein determining the extent of change comprises automatically determining the extent of change.

16. The method of claim 14, wherein determining the extent of change comprises determining the extent of change by a user viewing the sensible element.

17. The method according to claim 12, wherein viewing the sensible element further comprises:

printing a test patch on a recording medium; and outputting the recording medium.

18. The method according to claim 10, wherein the sensible element is a test patch formed on a photoreceptor.

19. The method of according to claim 10, wherein the sensor is an optical sensor.

20. The method according to claim 10, wherein changing at least one of the at least one characteristics of a test patch comprises disrupting a charge on an area of a photoreceptor underlying the test patch.

21. The method according to claim 20 wherein disrupting a charge on an area of the photoreceptor comprises operating a light source of the sensor at a greater than normal illumination.

22. The method according to claim 10, wherein the sensible element is a test patch carried on one of a photoreceptor, an intermediate transfer substrate or a final substrate surface.

23. A method of determining a location of a field of view of a sensor with respect to a sensible element, at least one non-positional characteristic of the sensible element disturbable by the sensor, comprising:

providing the sensible element;

moving the sensible element past the field of view of the sensor;

changing at least one of the at least one non-positional characteristic of the sensible element based on an interaction of the sensible element with the sensor;

obtaining data about the at least one of the at least one characteristic from the sensible element; and determining the location of the field of view of the sensor relative to the sensible element based on the obtained data.

24. A method of determining a location of a field of view of a sensor with respect to a sensible element formed on a surface, at least one characteristic of the sensible element disturbable by the sensor, comprising:

providing the sensible element at a first position on the surface;

moving the sensible element past the field of view of the sensor;

changing at least one of the at least one characteristic of the sensible element, while the sensible element is in the first position, based on an interaction of the sensible element with the sensor;

obtaining data about the at least one of the at least one characteristic from the sensible element; and determining the location of the field of view of the sensor relative to the sensible element based on the obtained data.

* * * * *